United States Patent [19]

Newsom

[11] Patent Number: 5,007,337

[45] Date of Patent: Apr. 16, 1991

[54] OVERSIZE BALE RELEASE MECHANISM FOR WASTE MATERIAL BALER

[75] Inventor: Horace R. Newsom, Midland, Tex.

[73] Assignee: Mosley Machinery Co., Inc., Waco, Tex.

[21] Appl. No.: 416,707

[22] Filed: Oct. 3, 1989

[51] Int. Cl.[5] ..... B30B 1/00; B30B 15/32

[52] U.S. Cl. ..... 100/188 R; 100/14; 100/191; 100/218; 100/232; 100/245; 100/253; 100/269 R

[58] Field of Search ..... 100/218, 14, 141-143, 100/187, 188 R, 191-192, 232, 242, 245, 253, 45, 269 R

[56] References Cited

U.S. PATENT DOCUMENTS

| | | | |
|---|---|---|---|
| 1,766,642 | 6/1930 | Jacobson et al. | 100/232 |
| 3,408,923 | 11/1968 | Bushmeyer | 100/218 X |
| 3,576,161 | 4/1971 | Wright | 100/218 X |
| 3,747,516 | 7/1973 | Wood | 100/218 X |
| 3,890,889 | 6/1975 | Fishburne | 100/232 X |
| 4,205,604 | 6/1980 | Ashley | 100/232 X |
| 4,337,694 | 6/1982 | Brown | 100/232 X |
| 4,382,406 | 5/1983 | Vezzani | 100/232 X |
| 4,417,510 | 11/1983 | Sharp | 100/232 X |
| 4,658,719 | 4/1987 | Jackson et al. | 100/218 |
| 4,729,301 | 3/1988 | Smith et al. | 100/218 X |
| 4,826,419 | 5/1989 | Coste et al. | 100/232 X |

FOREIGN PATENT DOCUMENTS

| | | | |
|---|---|---|---|
| 791164 | 12/1935 | France | 100/218 |

*Primary Examiner*—Harvey C. Hornsby
*Assistant Examiner*—Stephen F. Gerrity
*Attorney, Agent, or Firm*—Brumbaugh, Graves, Donohue & Raymond

[57] ABSTRACT

A horizontal waste material baling machine has a charging passage which leads to a compressing chamber of generally parallelopiped configuration and in which a charging plunger is reciprocably moveable for pushing waste material into the compressing chamber and compressing it into a bale. A discharge passage leads from the compressing chamber at right angles to the charging passage, and an ejection plunger is advanceable through the chamber and the discharge passage to eject the baled waste material. To ease the ejection of an oversize bale, the discharge passage wall adjacent the exit end of the charging passage is a vertically oriented planar surface of a structure that is moveable by a linear motor, such as a hydraulic cylinder, from a normal operative position at which the vertical planar surface and the opposite sidewall of the discharge passage determine the exit width to a position at which the planar surface is displaced by an amount it is desired to increase the exit width of the discharge passage.

7 Claims, 4 Drawing Sheets

OVERSIZE BALE RELEASE MECHANISM FOR WASTE MATERIAL BALER

BACKGROUND OF THE INVENTION

This invention relates to machines for baling waste material, such as paper, cardboard, used beverage cans, solid waste and the like and, more particularly, to improvements in waste baling machines of the horizontal type described in U.S. Pat. No. 4,729,301 to Smith and McDonough, dated Mar. 8, 1988, the disclosure of which is hereby incorporated herein by reference.

BACKGROUND OF THE INVENTION

The horizontal type baling machine disclosed by Smith et al. has an open-top waste receiving hopper having a floor and opposed vertical side walls. The head of a compression or charging plunger is reciprocably movable along the floor of the hopper to push waste material into and through an inlet or charging passage into a compression or baling chamber. A bale of material compressed in the baling chamber is ejected through a discharge passage extending at right angles to the charging passage by an ejection plunger which moves across the compression chamber and into the discharge passage and then tied or strapped to retain the material in a bale.

Operation of the machine is normally automatic, the charging plunger making several excursions or cycles through the hopper and charging passage and part way into the compression chamber to move waste material into the chamber and to compress it to a desired bale density. When the bale reaches the desired density, the compression plunger is moved to a position at which its inner face forms a sidewall of the compression chamber, whereupon the ejection plunger advances, preferably in stepwise fashion, through the compression chamber to eject the bale through the discharge passage. An automatic strapping mechanism is positioned just outside the discharge passage which, when the bale pauses between its step-by-step movements, encircles the bale with straps or wires.

Occasionally the charging plunger will move more waste material into the compression chamber than it is able to compress sufficiently to advance its inner face to its normal bale-ejecting position, i.e., with its inner face forming a sidewall of the compression chamber. When this occurs, a portion of the compressed bale protrudes into the charging passage causing the bale to be sufficiently wider than the width of the discharge passage that the ejection plunger is unable to eject it. Heretofore, such a jam has usually been cleared by retracting the compression plunger and manually pulling sufficient material out of the charging passage to permit the material remaining in the baling chamber to be compressed to a size that can be ejected. This procedure is dangerous, inefficient and results in costly down-time of the baling machine.

In the known mechanism for releasing an oversize bale from a horizontal-type waste material bale described in U.S. Pat. No. 4,658,719, the sidewall of the discharge passage adjacent the charging passage has inner and outer sections, divided parallel to the plane of the wall, the inner section of which is movable vertically with respect to the outer section and is sufficiently thick, then when lifted out of the way the discharge passage is enlarged by an amount equal to the thickness of the inner section, so as to ease the ejection of an oversize bale. This inner wall section, which typically may be fifty inches wide and six inches thick and therefore very heavy, must be moved vertically at least a distance equal to the height of the compression chamber, typically two feet or more, by a linear motor, such as an hydraulic cylinder. This solution for the occasional occurrence of an oversize bale has the obvious disadvantages of requiring precise machining of the confronting surfaces of thick, relatively large area wall sections so as to be slidable relative to each other, and the need for a heavy-duty, and thus expensive, linear hydraulic motor for lifting the heavy inner wall section the few times that it may be required.

In another mechanism addressing the problem of releasing an oversize bale from a horizontal-type waste material baler, described in U.S. patent application Ser. No. 327,828 filed by Applicant on Mar. 23, 1989, and now abandoned, the sidewall of the discharge passage adjacent the charging passage is replaced with a hingedly mounted door arranged to be movable parallel to itself and out of the way by a linear hydraulic motor so as to effectively widen the discharge passage by the thickness of the door, thereby to ease the ejection of an oversize bale. Because of the extreme forces encountered in the compression chamber and discharge passage the door is necessarily of rugged construction and therefore heavy, with the consequence that a door of sufficient thickness to achieve a meaningful widening of the discharge passage puts an extremely heavy load on and adversely affects the operation of the hinge mechanism.

SUMMARY OF THE INVENTION

It is an object of the present invention to provide mechanical means, simpler in construction and easier to operate than known mechanisms, for facilitating ejection of an oversize bale from the compression chamber of a horizontal-type waste material baler.

This object is accomplished by replacing the sidewall of the discharge passage adjacent the charging passage with a vertically oriented planar surface of a structure mounted for limited back and forth horizontal movement parallel to the sidewalls of the charging passage. With the structure in its normal operative position the vertically oriented planar surface is disposed at right angles to the sidewalls of the charging passage and positioned to cause the exit of the discharge passage to correspond substantially to the width of the ejection plunger and, in the event of an oversize bale, is movable, by a linear motor, for example, to a second position displaced from the first to increase the width of the discharge passage by a predetermined amount sufficient to ease the ejection of an oversize compressed bale of waste material.

Other objects, features and advantages of the invention, and a better understanding of its construction and operation, will become apparent from the following detailed description, read in conjunction with the accompanying drawings.

DESCRIPTION OF THE PREFERRED EMBODIMENTS

Figure 1:
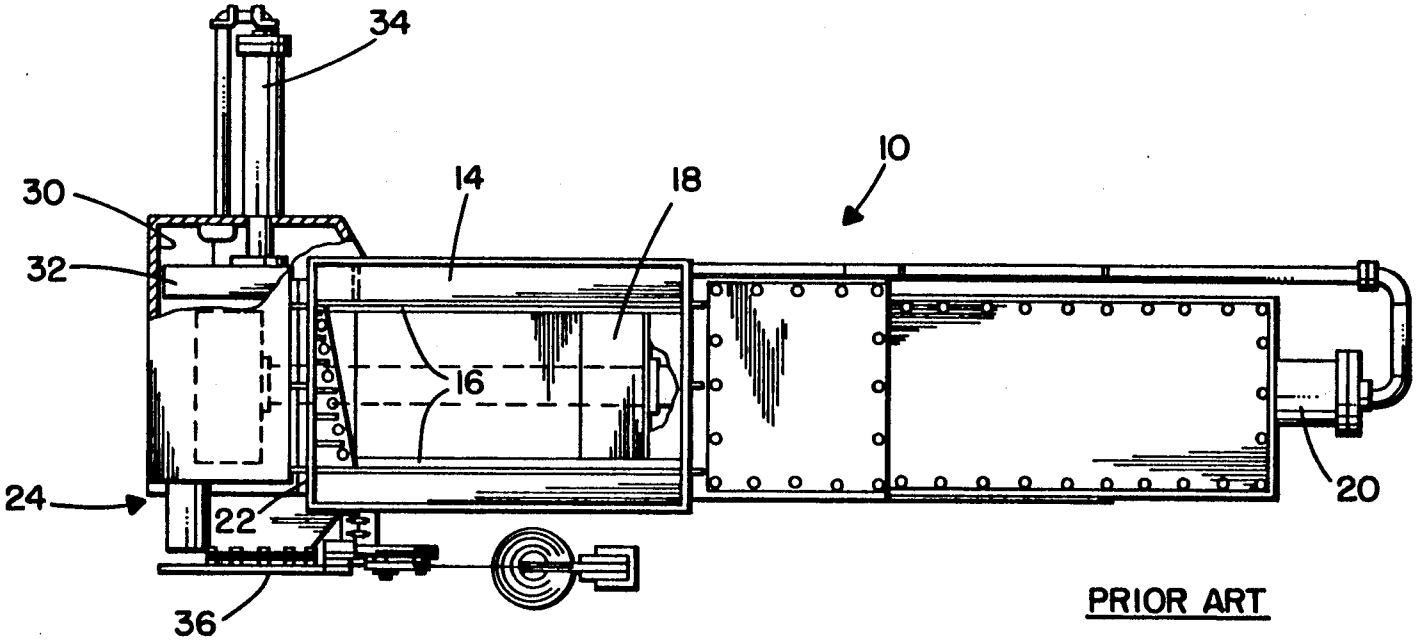
PRIOR ART FIG. 1.
FIG. 1 is plan view of a waste material baling machine of the type in which the present invention may be embodied, with a portion of the top wall of the compression chamber removed.
Figure 2:
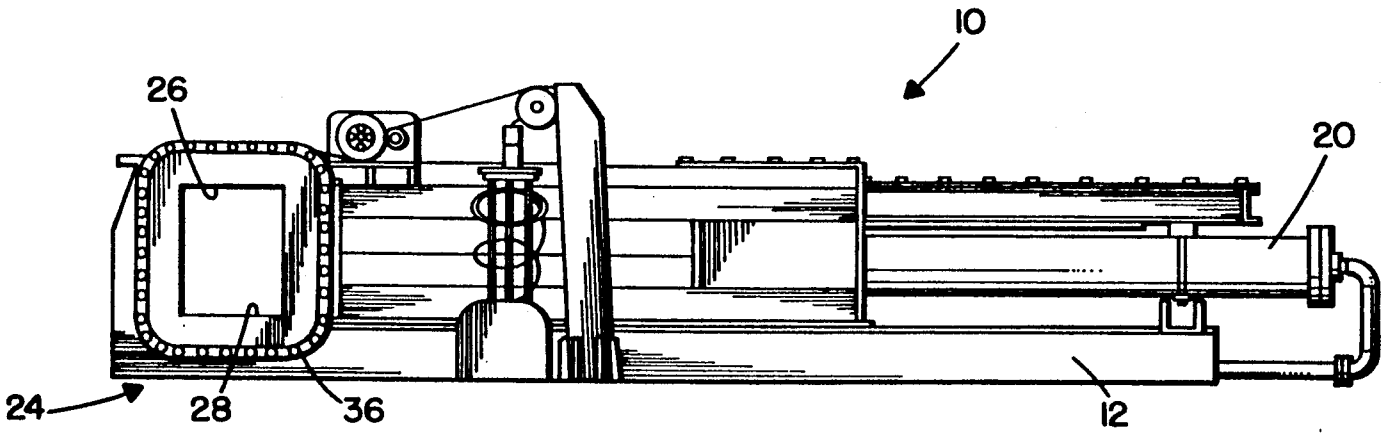
FIG. 2 is front elevation view of the machine shown in FIG. 1.

Referring to FIGS. 1 and 2, a known machine 10 for baling waste material, such as paper, cardboard, corrugated containers, used beverage cans, and the like, is supported horizontally on a body member 12 and has a generally rectangular hopper 14 into which waste material is loaded. The hopper has a flat bottom floor and opposed vertical sidewalls 16 between which the plunger 18 of a hydraulic charging or compression ram 20 is moved horizontally, along the floor. The end wall 22 of the hopper has a charging passage extending therethrough in alignment with and conforming in outline to the plunger 18 which leads to a compression or baling chamber 24 of generally parallelopiped configuration. The stroke or extent of travel of the plunger 18 is from the position shown in solid line in FIG. 1 to the position within the baling chamber 24, shown in broken line in FIG. 1. The charging ram usually makes several excursions or cycles through the hopper and charging passage so as to introduce the compressible waste material into the baling chamber in batches until the compressed bale has the desired density, at which time the compression ram is moved to a position at which the inner face of the plunger 18 is coextensive with and forms a sidewall of the compression chamber 24.

The compression chamber 24 has a fixed upper wall 26, a fixed floor 28, and a fixed sidewall 30 opposite and spaced from the exit end of the charging passage. The compression chamber also has an end wall defined by the face of the plunger 32 of an ejection ram 34 which, when retracted, is preferably coextensive with a sidewall of the charging passage as shown, although it may assume a more retracted position.

When the desired bale density is reached, and the compression plunger is moved to a position where its inner face forms a sidewall of the compression chamber, the plunger of the ejection ram 34 advances through the compression chamber, preferably in stepwise fashion, to eject a compressed bale through a discharge passage, and to force the preceding bale through a strapping mechanism 36 which, when the latter bale pauses in its step-by-step ejection movement, applies several straps or wires to the compressed material to retain its bale shape.

Figure 3:
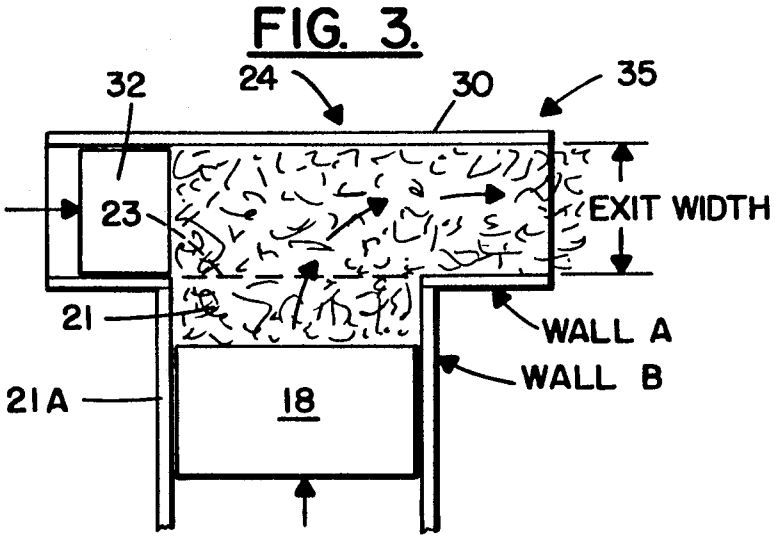
FIG. 3 is a diagrammatical plan view of a compression chamber, with its top wall removed, which illustrates the nature of the oversize bale problem.

As best seen in the somewhat schematic FIG. 3 plan view of the compression chamber 24 with its top removed, in use the plunger 18 of the charging ram is advanced to push waste material through the charging passage 21 defined by opposing sidewalls designated 21A and wall B, respectively, and into the compression chamber. One end wall of the chamber is defined by the inner face of the ejection plunger 32 of an ejection ram, which normally is positioned as shown during the compression cycle, although it may be retracted further if desired. The charging ram plunger 18 has an overtravel into the chamber 24, beyond the exit end of the charging passage (defined by the dash line 23) to cause the solid waste to flow through the baler toward the exit of the discharge passage 35 in the pattern indicated by the arrows and to compress it into a bale. After the waste material in the chambers has been compressed to a desired density, the charging ram is positioned such that the inner face of plunger 18 is substantially flush with the adjacent wall of the discharge passage, designated as wall A. The ejection plunger 32 then is advanced step-by-step to push the compressed solid waste out of the compression chamber through a discharge passage 35 having a fixed exit width, which retains the compressed waste in its baled shape until it is tied.

Figure 4:
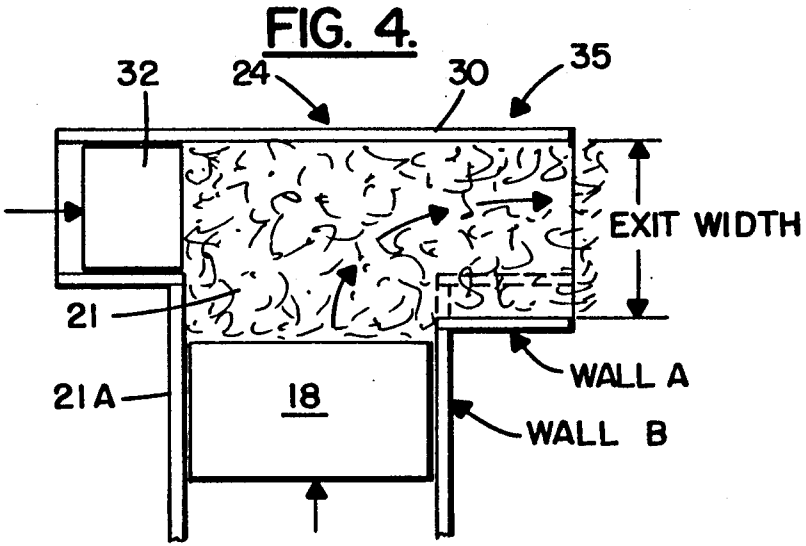
FIG. 4 is a diagrammatic plan view of a compression chamber, with the top wall removed, schematically showing how the present invention increases the exit width of the discharge passage.

Occasionally, because of variations in the composition of the solid waste material or other factors, the compression chamber may be charged with such an excess of waste material that the compression plunger 18 is unable to push the last charge or batch of material completely out of the charging passage and into the chamber with the consequence that a part of the charge protrudes back into the charging passage, making it difficult, if not impossible, for the ejection ram 32 to eject the bale through the discharge passage 35. When this situation occurs, it would be desirable to increase the width of the exit of discharge passage 35, upon command, by shortening wall B of the charging passage so that the adjacent wall of the discharge passage, i.e., wall A, can be moved back, as illustrated in FIG. 4, from the normal position shown in dash lines to the position shown in solid line.

Figure 5B:
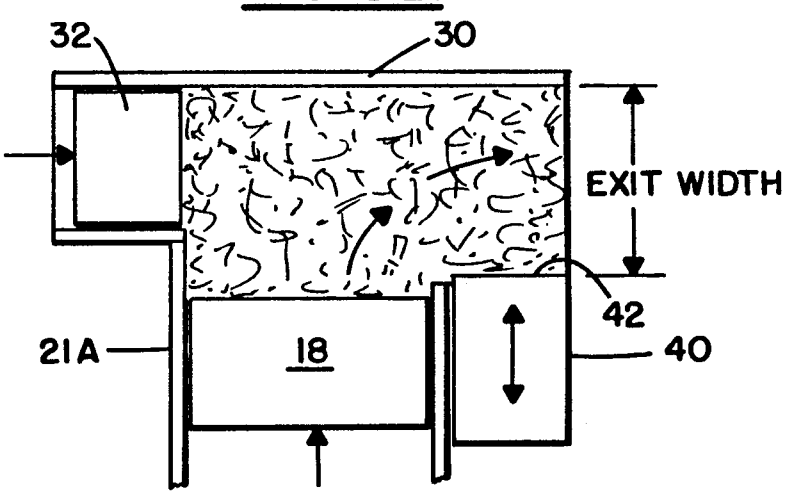
FIGS. 5A and 5B are diagrammatic plan views of a compression chamber, with the top wall removed, schematically illustrating how the present invention replaces a normally fixed wall of the discharge passage with a movable wall.
Figure 5A:
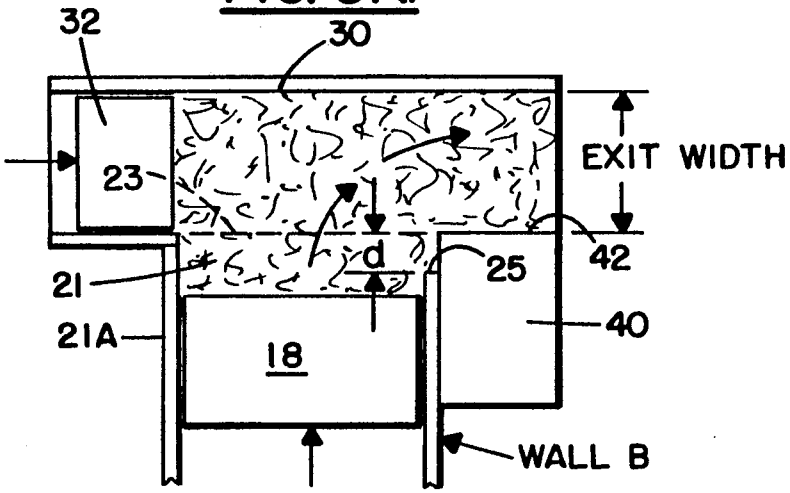

Referring to FIGS. 5A and 5B, the present invention overcomes the problem of ejecting an oversize bale by making the inner end of wall B of the charging passage shorter than the opposing sidewall 21A by the desired amount of widening of the discharge passage, and replacing the wall A with a structure 40 having a vertically oriented planar surface 42 opposing the fixed wall 30 of the compression chamber and discharge passage and which is normally positioned as shown in FIG. 5A, that is, aligned with the exit 23 of the charging passage and with wall 30 defining the exit width of the discharge passage. When the structure is in the FIG. 5A position a step 25 is created at the inner end of wall B of the charging passage, but being downstream of the solid waste flow pattern it does not seriously adversely affect the flow of the waste material. Should it become necessary to increase the exit width of the discharge passage, the structure 40 is movable in a direction parallel to the sidewalls of the charging passage with one surface thereof in sliding contact with the outer surface of wall B, to the position schematically illustrated in FIG. 5B at which the vertically oriented planar surface 42 is substantially aligned with the inner end of wall B, thereby to increase the exit width by the amount of travel, i.e., the distance "d", of the structure 40, thereby to ease the ejection of an oversize bale.

Figure 6:
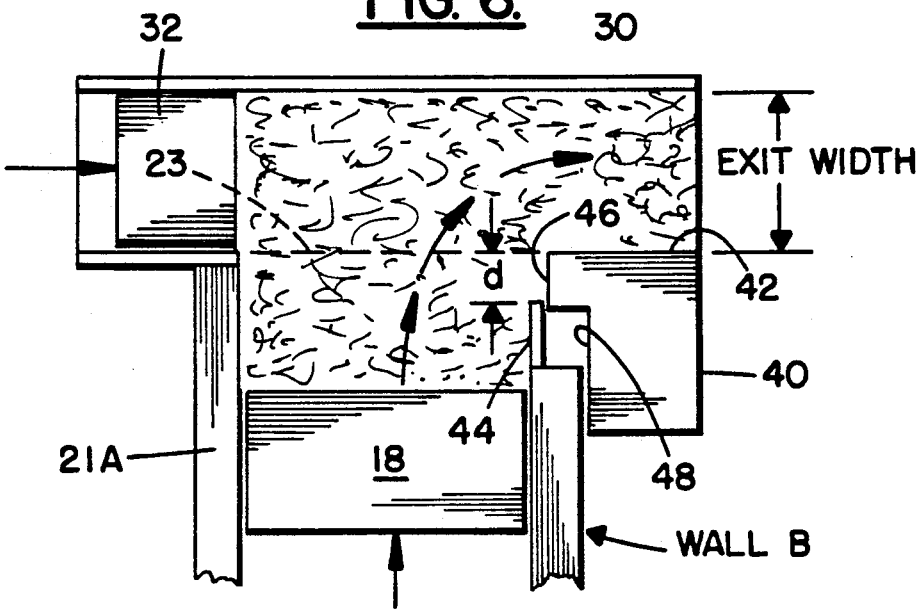
FIG. 6 is a diagrammatic plan view of a compression chamber, with its top wall removed, schematically showing a structure for providing a movable wall for the discharge passage.

As schematically shown in FIG. 6, in order to minimize the effect of the step 25 at the inner end of the shortened wall B, which in practice may be several inches thick, the inner surface thereof is extended by a plate 44, having a thickness of the order of ½ inch, welded to wall B. The inner end of plate 44 terminates at a point spaced from the exit 23 of the charging passage by the distance "d", which may be of the order of four to six inches in a practical baling machine. The structure 40 has the cross-sectional configuration schematically shown in FIG. 6, essential features of which are a cut-out at the left hand side (as viewed in FIG. 6) of a depth substantially equal to the thickness of wall B less the thickness of plate 44 so as to provide second and third vertically oriented planar surfaces 46 and 48 which respectively engage and slide along the outside of plate 44 and the outside of wall B as the structure is moved from the position shown in FIG. 6. The width of surface 46 is approximately equal to the width of plate 44 so that the surface 42 is substantially aligned with the inner edge of plate 44 after the structure 40 has been moved the distance "d".

Figure 8:
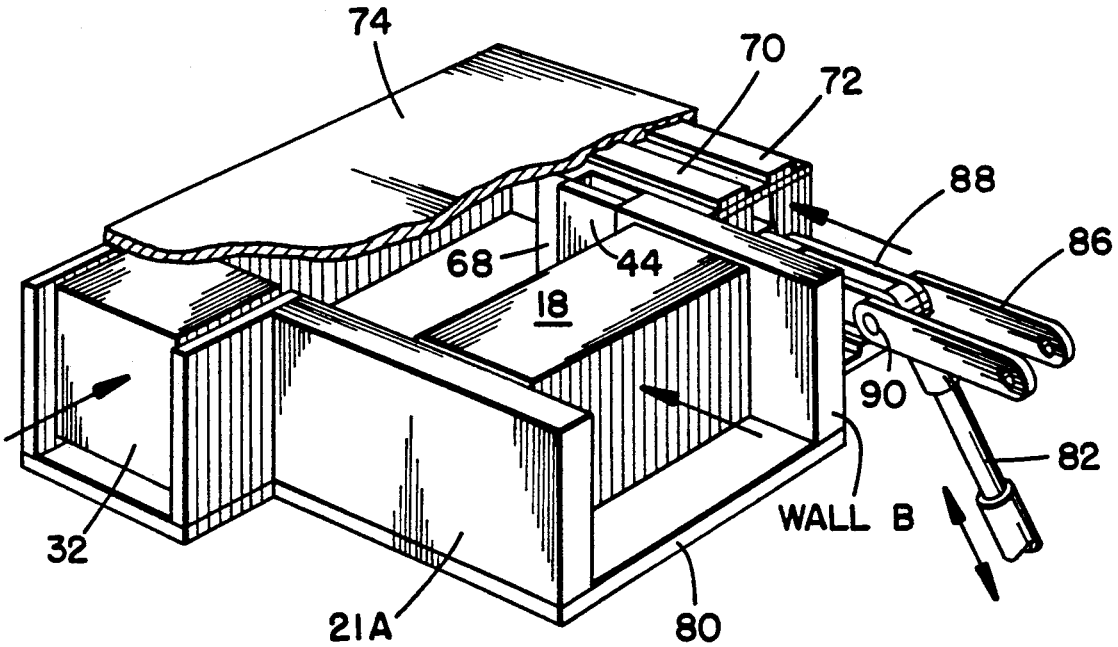
FIG. 8 is a perspective view of a compression chamber, with the top wall partially cut away, in which the movable wall is embodied.
Figure 7:
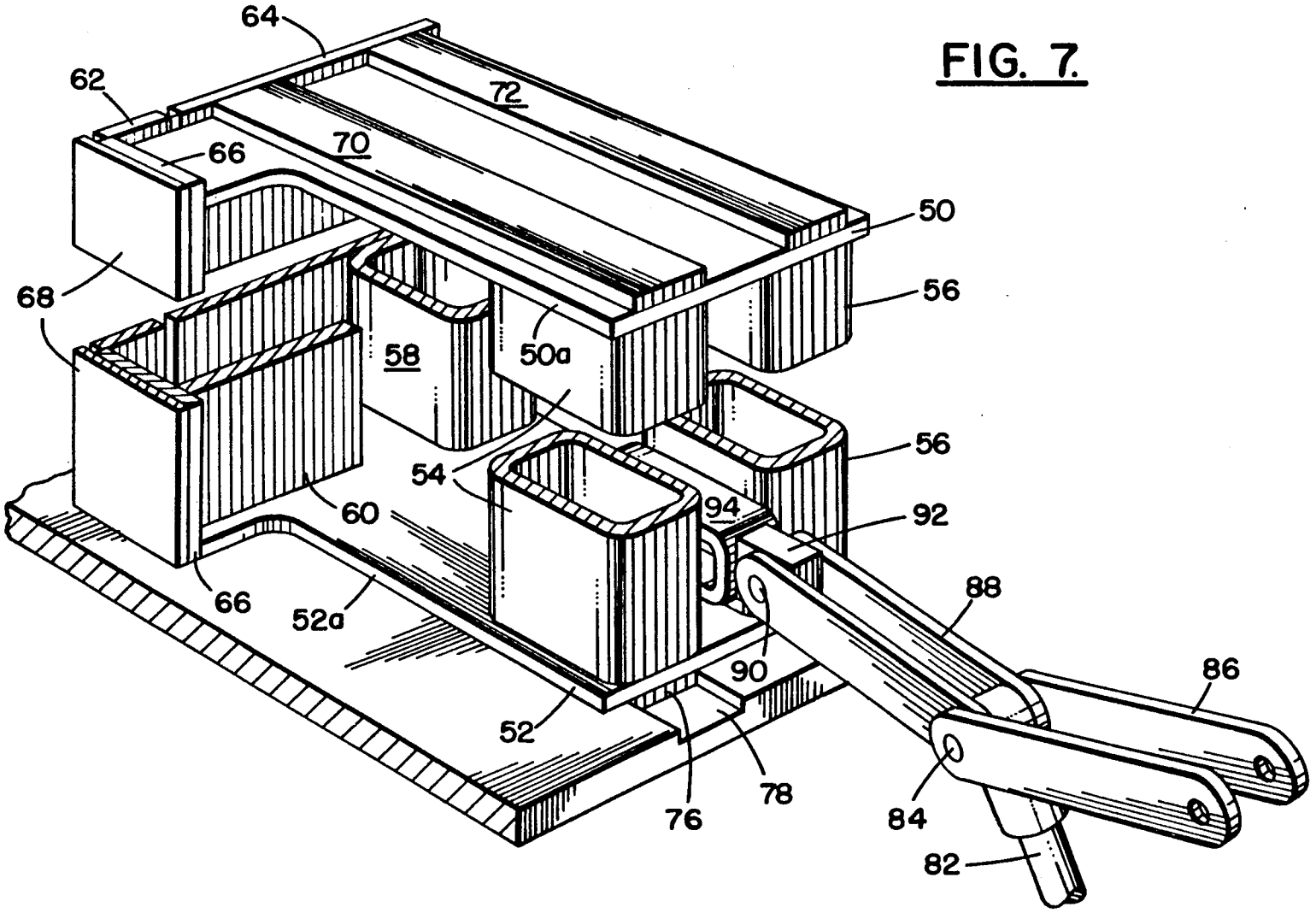
FIG. 7 is a perspective view, partially cut away, showing details of construction of a preferred embodiment of structure for providing the movable wall.

The movable structure illustrated in FIG. 6 typically rests on a flat floor plate (not shown in FIG. 6) and is covered by a flat lid plate (also not shown in FIG. 6). Because of the substantial force that can be exerted against the surface 46 when the ejection plunger 32 moves inward and across the compression chamber, guide plates are provided at the top and bottom of the structure which mate with the guides secured to floor and lid plates as shown in FIGS. 7 and 8, which respectively are a perspective view, partially cut away, showing a presently preferred construction of the structure 40, and a perspective view of the compression chamber, with the lid plate partially removed, assembled with the structure 40. In a practical embodiment, the structure has a generally parallelopiped shape having a width of about twenty-four inches, a length of about thirty inches, and an overall height of thirty-three inches, and is fabricated from a pair of upper and lower one-inch thick steel plates 50 and 52, respectively, welded to the upper and lower ends of three hollow steel columns 54, 56 and 58, having rectangular cross-sections typically six inches wide by ten inches long and a wall thickness of one-half inch, and a one-inch thick steel gusset plate 60 oriented in the width direction of the structure. The vertically oriented planar surface 42 is provided by upstream and downstream steel wear plates 62 and 64, respectively, each ¾-inch thick and welded to the top and bottom plates 50 and 52. A steel nose load plate 66 one-inch thick and about seven inches wide is welded to the forward side edge of plates 50 and 52 that slides on wall B of the charging passage, and is covered by a ½-inch thick steel wear plate 68 to make a right-angle corner with plate 62.

To accommodate the extreme forces exerted against the surface of wear plate 68 when the structure is in its normal operative position, the back-and-forth movement of the structure is guided by a first pair of steel guide plates 70 and 72, respectively five and four inches wide and each one-inch thick, welded to the upper surface of top plate 50 and spaced six inches from each other to mate with correspondingly shaped and spaced grooves formed in the under surface of the lid plate 74 (FIG. 8), and a second pair of similar steel guide plates secured to the outer surface of bottom plate 52, one which is visible at 76 in FIG. 7, which engage respective grooves, one of which is shown at 78, formed in the upper surface of the floor plate 80 of the baling structure. As shown in FIG. 8, the lid plate 74 may extend over and serve as the upper wall for the compression chamber and the charging and discharge passages, and the floor plate 80 may similarly serve as the floor for the entire assembly.

Top and bottom plates 50 and 52 have matching cutouts 50*a* and 52*a* of generally rectangular shape formed therein which extend rearwardly about twenty-two inches from the inner edge of plates 66 and 68, and which are approximately six inches wide when the combined thickness of plates 66 and 68 is included, so as to allow as much as eighteen to twenty inches of movement of vertically oriented plates 62 and 64 from the normal operative position, and to accommodate a wall B thickness, less the thickness of extended plate 44, of as much as six inches.

The structure 40 is retracted from and returned to its normal operative position by a linear motor, such as a hydraulic cylinder (not shown) applying force through its piston rod 82 to the pivot 84 of a linkage mechanism one arm 86 of which is pivotably secured to the bed of the baling machine in the vicinity of the baling chamber, and another arm 88 of which is pivotably secured at 90 to a steel bracket 92 which is, in turn, welded to a handle 94 which may take the form of a section of a hollow steel column of the kind used for columns 54, 56 and 58 and having a height so as to fit between and be welded to columns 54 and 56. The linkage is so arranged that downward movement of piston rod 82 retracts the structure 40 from its normal operative position and upward movement returns it.

As best seen in FIG. 8, the outer surface of wall extender plate 44, which may be four to six inches wide, is machined for smooth sliding engagement with the also machined nose wear plate 68. The guide grooves formed in the lid and floor plates are so located with respect to the outer surface of wall B of the charging passage that edges 50*a* and 52*a* of the cutouts in plates 50 and 52, respectively, are disposed in close proximity to or, if desired, in sliding contact with the outer surface of wall B. The structure illustrated in detail in FIGS. 7 and 8 being the functional equivalent of the structure schematically illustrated in FIG. 6, further description of its operation would be redundant.

It will be recognized that by supporting top and bottom plates 50 and 52 on hollow columns, it is possible to fabricate a structure sufficiently large to provide a movable discharge passage wall of acceptable height and length, which at the same can be retracted a distance to achieve useful widening of the exit of the discharge channel, yet sufficiently rugged and durable to withstand the extreme forces to which it is subjected without being so heavy as to require a powerful, and thus expensive, linear motor to actuate it.

It will be seen from the foregoing description that the invention satisfies the object of providing a mechanism for easing the ejection of an oversize bale from a horizontal-type waste material baling machine. It is to be understood, however, that the disclosed specific embodiment, while illustrating the principles of the invention, is susceptible of modification in the details, including dimensions, of its construction. It is intended that modifications to the inventive concept which would be obvious to those skilled in the art be considered as included within the scope of the invention.

I claim:

1. A waste baling machine including a compressing chamber of generally parallelopiped configuration having fixed opposite top and bottom walls and a fixed first sidewall, a horizontally extending charging passage including said fixed top and bottom walls and having an exit at said compressing chamber opposite said fixed first wall, a charging plunger reciprocable in said charging passage for pushing waste material into said compressing chamber and defining, in one position, a fourth compressing chamber wall, a horizontally extending discharge passage defined by said top and bottom walls, said fixed first sidewall and another sidewall adjacent the exit end of said charging passage and leading from said compressing chamber at right angles to said charging passage, and an ejection plunger advanceable through said compressing chamber and said discharge passage for ejecting bales of compressed waste material which, when in a retracted position, defines a fifth compressing chamber wall, wherein the sidewall of the discharge passage which is adjacent the exit end of said discharge passage comprises a first vertically oriented planar surface supported on a structure which is mounted for back and forth horizontal movement in a direction parallel to the sidewalls of said charging passage, said first vertically oriented planar surface normally being positioned substantially adjacent the exit end of said charging passage and perpendicular to the sidewalls of said discharge passage and together with said fixed first sidewall defining the normal width of the discharge passage, said structure being movable if desired to a second position at which said first vertically oriented planar surface is displaced parallel to itself from said normal position in a direction to increase by a desired amount the width of the discharge passage throughout its length to permit the ejection therethrough of an oversize compressed bale of waste material, wherein the sidewall of said charging passage which is adjacent said first vertically oriented planar surface is shorter than the opposing sidewall of the charging passage by approximately twice the desired increase in the width of said discharge passage and is extended by substantially said desired distance by an extender plate which is much thinner than said sidewall, and wherein said structure has a second vertically oriented planar surface disposed adjacent and perpendicular to said first vertically oriented planar surface for slidably engaging the outer surface of said extender plate as said structure is moved back and forth.

2. A waste baling machine according to claim 1, wherein said machine further comprises linkage means secured to said structure, and motor means operatively coupled to said linkage means for retracting the structure from said normal operative position in the event of an oversize bale and returning it to said normal operative position after an oversize bale has been ejected.

3. A waste baling machine according to claim 1, wherein said movable structure comprises elongated top and bottom plates and structural means spacing said plates apart a distance substantially equal to the height of said first fixed sidewall, a first vertically oriented plate extending between said top and bottom plates at one end thereof for defining said first vertically oriented planar surface, and a second vertically oriented plate extending between said top and bottom plates disposed adjacent to and perpendicular to said first vertically oriented plate for defining said second vertically oriented surface.

4. A waste baling machine according to claim 3, wherein said structural means comprises a plurality of spaced apart column members secured at their ends to said top and bottom plates.

5. A waste baling machine according to claim 4, wherein said column members are hollow so as to provide a desired structural strength while minimizing the weight of the structure.

6. A waste baling machine according to claim 3, wherein said structure is mounted between fixed lid and floor plates and includes mating guide means for guiding the back and forth travel path of said structure.

7. A waste baling machine according to claim 6, wherein said guide means comprises at least one elongated guide plate secured to each of said top and bottom plates which respectively mate with groove means formed in said lid and floor plates.

* * * * *